US007392980B2

(12) United States Patent
Takeuchi et al.

(10) Patent No.: US 7,392,980 B2
(45) Date of Patent: Jul. 1, 2008

(54) SHEET FEED DEVICE AND IMAGE FORMING APPARATUS

(75) Inventors: Shin Takeuchi, Kanagawa (JP); Kazuyuki Tsukamoto, Kanagawa (JP); Minoru Ohshima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 168 days.

(21) Appl. No.: 11/505,400

(22) Filed: Aug. 17, 2006

(65) Prior Publication Data

US 2007/0126171 A1 Jun. 7, 2007

(30) Foreign Application Priority Data

Dec. 6, 2005 (JP) ..... 2005-352472

(51) Int. Cl.
*B65H 3/52* (2006.01)

(52) U.S. Cl. ..... 271/125; 271/124; 271/10.01; 271/265.01; 271/270; 271/110

(58) Field of Classification Search ..... 271/125, 271/10.01, 265.01, 270, 110, 121, 122
See application file for complete search history.

(56) References Cited

U.S. PATENT DOCUMENTS

| | | | | |
|---|---|---|---|---|
| 5,449,162 | A * | 9/1995 | Saito et al. | 271/122 |
| 6,378,858 | B1 * | 4/2002 | Suga | 271/10.01 |
| 6,672,579 | B2 * | 1/2004 | Araki et al. | 271/122 |
| 6,997,453 | B2 * | 2/2006 | Matsuda et al. | 271/122 |
| 7,036,815 | B2 * | 5/2006 | Yamamoto | 271/124 |
| 7,052,008 | B2 * | 5/2006 | Mitsuya et al. | 271/122 |
| 7,234,695 | B2 * | 6/2007 | Tsukamoto et al. | 271/122 |
| 7,267,339 | B2 * | 9/2007 | Mitsuya et al. | 271/262 |
| 7,334,788 | B2 * | 2/2008 | Sakamaki et al. | 271/125 |
| 2005/0073088 | A1 * | 4/2005 | Watase | 271/121 |
| 2005/0184447 | A1 * | 8/2005 | Tsukamoto et al. | 271/109 |
| 2006/0180990 | A1 * | 8/2006 | Ueda et al. | 271/121 |

FOREIGN PATENT DOCUMENTS

| | | |
|---|---|---|
| JP | A-05-032356 | 2/1993 |
| JP | A-10-095547 | 4/1998 |
| JP | A-2000-044076 | 2/2000 |
| JP | A-2000-264489 | 9/2000 |
| JP | A-2001-213540 | 8/2001 |

* cited by examiner

*Primary Examiner*—Dave Bollinger
*Assistant Examiner*—Luis A Gonzalez
(74) *Attorney, Agent, or Firm*—Morgan, Lewis & Bockius LLP

(57) ABSTRACT

A sheet feed device includes: a conveyor roller that rotates in a first direction; a separation roller rotatable in a second, reverse to the first direction, that nips a sheet with the conveyor roller; a sheet detector provided at a detecting position to detect a number of sheets; a pressure generator that generates a pressure to press the separation roller against the conveyor roller; a separation torque generator that generates a separation torque to convey the sheet on the separation roller in the second direction; and a controller that, if two or more sheets are detected, applies the pressure and/or the separation torque to the separation roller to separate the sheets until the detected number of sheets is decreased to be one, and that, after the number of sheets becomes one, controls the pressure and/or the separation torque to adjust a position of the sheet on the separation roller to a target position.

12 Claims, 15 Drawing Sheets

SHEET FEED DEVICE AND IMAGE FORMING APPARATUS

BACKGROUND

1. Technical Field

The present invention relates to a sheet feed device and to an image forming apparatus having the sheet feed device.

2. Related Art

In an image forming apparatus such as a copier or printer, a sheet feeder is provided to pick up and feed sheets one after another from a pile of stacked sheets to an image forming section. However, a problem exists with this kind of sheet feeder, namely, the occurrence of double feed of overlapped sheets, which is caused by friction between the sheets. To prevent double feed, it is necessary to appropriately adjust control parameters for a separation roller, such as a contact pressure and a separation torque.

SUMMARY

According to an aspect of the present invention, there is provided a sheet feed device including: a conveyor roller that rotates in a first, conveying direction to convey a sheet for conveyance; a separation roller that is pressed against the conveyor roller, to nip the sheet for conveyance at a contact area formed between the separation roller and the conveyor roller, the separation roller being rotatable in a second direction, reverse to the first, conveying direction, to convey a sheet for separation; a sheet detector that is provided at a detecting position at the contact area or downstream of the contact area, to detect a number of sheets for conveyance passing through the detecting position; a pressure generator that generates a pressure by which the separation roller is pressed against the conveyor roller; a separation torque generator that generates a separation torque by which the sheet for separation on the separation roller is conveyed in the second, reverse direction; and a controller that, if two or more sheets are detected at the sheet detector, applies at least one of the pressure and the separation torque to the separation roller to separate the sheets one by one, until the number of sheets detected at the sheet detector is decreased to be one, and that, after the sheet detector detects the number of sheets to be now one, controls at least one of the pressure and the separation torque, to adjust and maintain a position of a lead edge the sheet for separation on the separation roller to a target position between the contact area and the detecting position, until conveyance of the sheet for conveyance on the conveyor roller finishes.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described with reference to the appended drawings.

First Exemplary Embodiment

Figure 1:
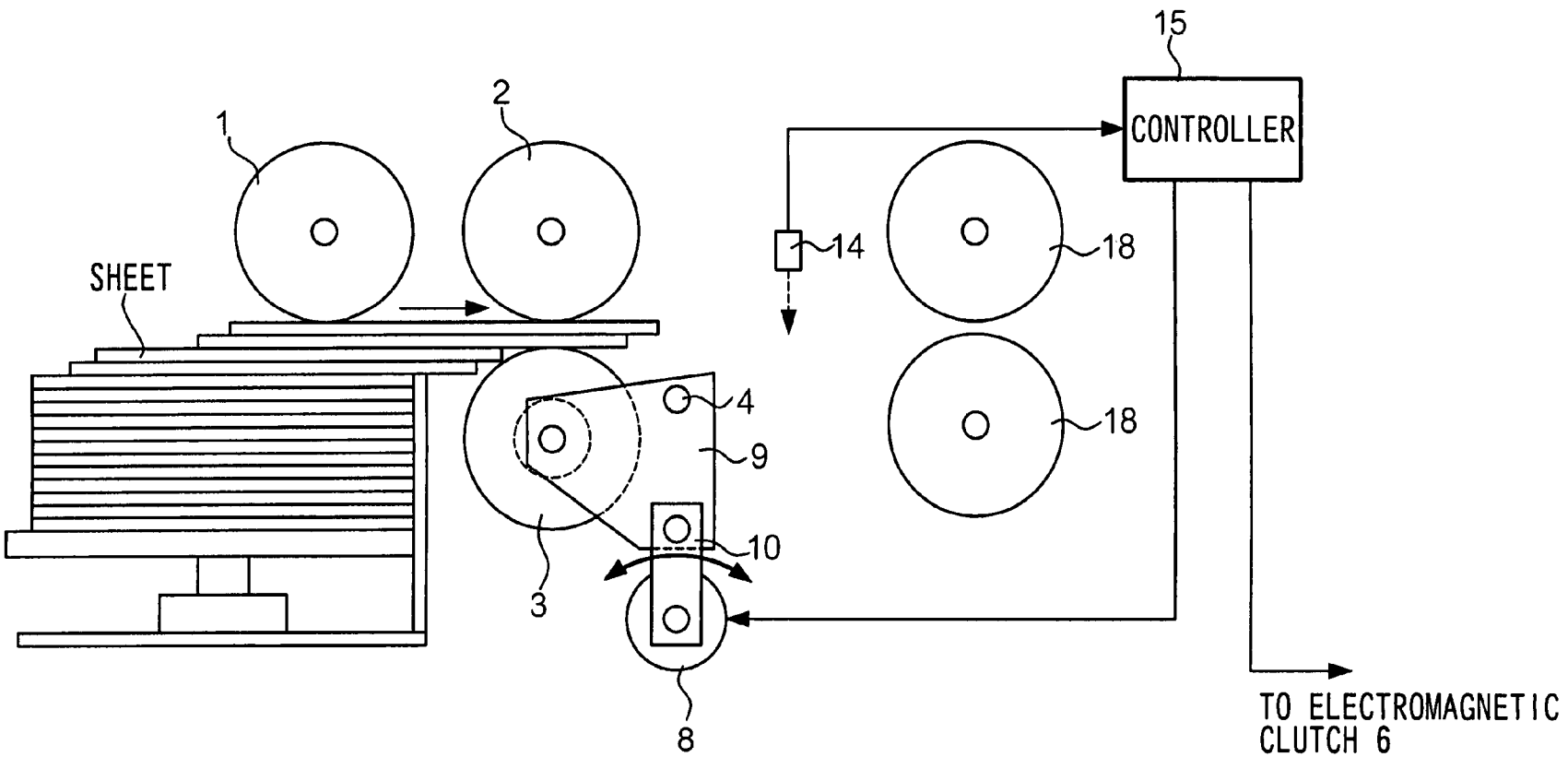
FIG. 1 is a diagram showing a structure of a sheet feed device according to the first exemplary embodiment of the present invention.

FIG. 1 shows a structure of a sheet feed device according to the first exemplary embodiment of the present invention. This sheet feed device is provided in an image-forming apparatus such as a copier, facsimile, printer, etc. Sheets fed by the sheet feed device are supplied to an image-forming unit in the image forming apparatus. The image-forming unit forms images on the sheets fed into it.

As shown in FIG. 1, a sheet feed roller 1 rotates sheets stacked on a tray, and feeds the sheets to a contact area (hereinafter referred to as "contact area A") between a conveyor roller 2 and a separation roller 3.

The conveyor roller 2 has a central axle held by a holder 9, and is rotatable around it. As a sheet to be conveyed reaches the contact area A, the separation roller 3 is pressed against the conveyor roller 2, thereby nipping a sheet at the contact area A, whereby the conveyor roller 2 conveys the sheet. During this time, the sheet feed roller 1 is separated to be free of its rotation drive system, and the sheet feed roller 1 freely rotates as the sheet is fed. The separation roller 3 is also drivably rotatable in a direction opposite to the direction of conveyance of the sheet being conveyed by the conveyor roller 2. The holder member 9 is rotatably supported at a fulcrum 4. Paired downstream conveyor rollers 18 further convey the sheet being conveyed from the left to the right, passing the contact area A, as shown in the figure.

The paired downstream conveyor rollers 18 are provided on the downstream side, at a set distance from the position of the separation roller 3 or a sheet sensor 14. When a lead edge of a sheet reaches a contact area (hereinafter referred to as a contact area B) of the paired downstream conveyor rollers 18, these rollers 18 start rotating and feed the sheet downstream where a process is performed by an image forming section or the like of the image forming apparatus.

Figure 2:
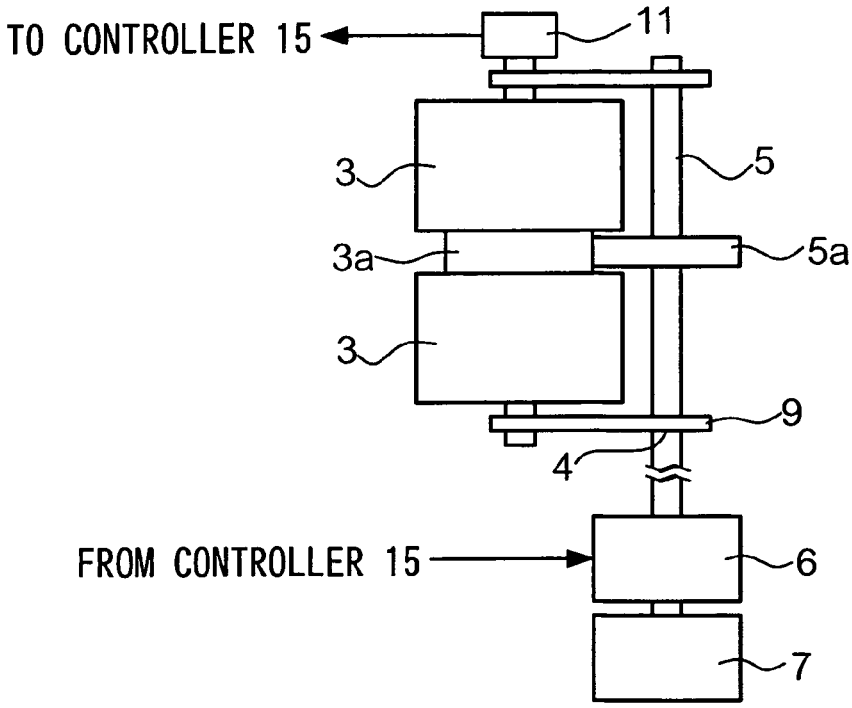
FIG. 2 is a diagram showing a structure of a separation roller and a drive system thereof, according to the exemplary embodiment.

FIG. 2 shows a structure of the separation roller 3 viewed from the lower side. A drive shaft 5 is rotatably supported at the fulcrum 4, like the holder member 9. This drive shaft 5 transmits torque to the separation roller 3 by gears 5*a* and 3*a*. The drive shaft 5 is connected also to a rotation shaft of a motor 7 by an electromagnetic clutch 6. The motor 7 is, for example, a stepping motor which transmits torque to the separation roller 3 by the drive shaft 5 and gears 5*a* and 3*a*, to drive the separation roller 3 to rotate in a direction in which sheets are pushed back toward the tray. The torque transmitted from the motor 7 to the separation roller 3 is determined by a transmission torque set in the electromagnetic clutch 6. The transmission torque can be adjusted by causing an electric current to flow through the electromagnetic clutch 6. Torque generated at the separation roller 3 under the action of the motor 7 and electromagnetic clutch 6 becomes a separation torque. This separation torque functions to separate one sheet on the side of the separation roller 3, from plural sheets which are being fed in an overlapping state, and to send the one sheet back to the tray. If only one sheet is passing the contact area A, it is not necessary for a separation torque to be generated. In this case, the electromagnetic clutch 6 is shut off, and the separation roller 3 rotates as a slave to the conveyor roller 2.

In FIG. 1, an arm 10 is fixed to the rotation shaft of the motor 8. An end of the arm 10 is engaged with the holder member 9 of the separation roller 3. As the motor 8 swings the arm 10 in an anticlockwise direction, the swing of the arm 10 causes the holder member 9 to pivot clockwise on the fulcrum 4 acting as a center. The separation roller 3 is thereby pressed against the conveyor roller 2. Therefore, a pressure by which the separation roller 3 is pressed against the conveyor roller 2 can be adjusted by adjusting the torque generated by the motor 8.

The separation roller 3 is provided with an encoder 11 to detect a rotation angle or a number of turns of the separation roller 3. A sheet contacting the separation roller 3 moves substantially in the same direction as the outer circumference of the separation roller 3 Accordingly, a position of the sheet can be roughly calculated by the controller 15 simply by detecting a rotation angle or a number of turns of the separation roller 3, relative to a reference position.

Figure 3:
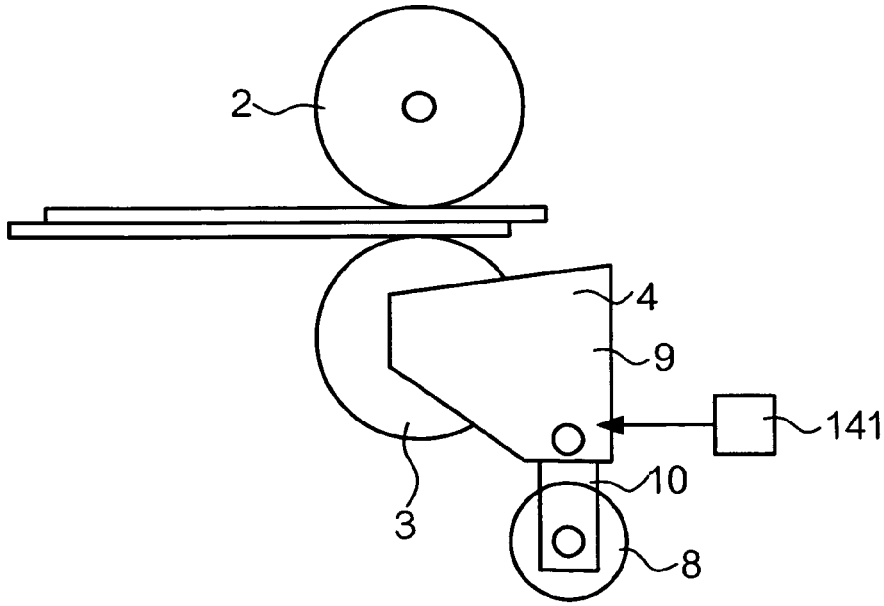
FIG. 3 is a diagram showing an example of a structure of a sheet sensor according to the exemplary embodiment.
Figure 4:
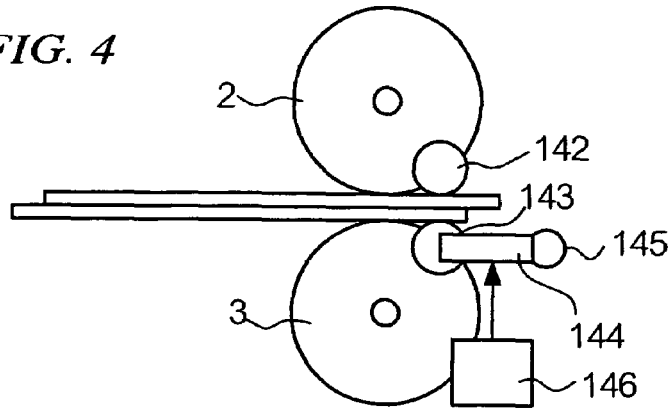
FIG. 4 is a diagram showing another example of a structure of the sheet sensor according to the exemplary embodiment.
Figure 5:
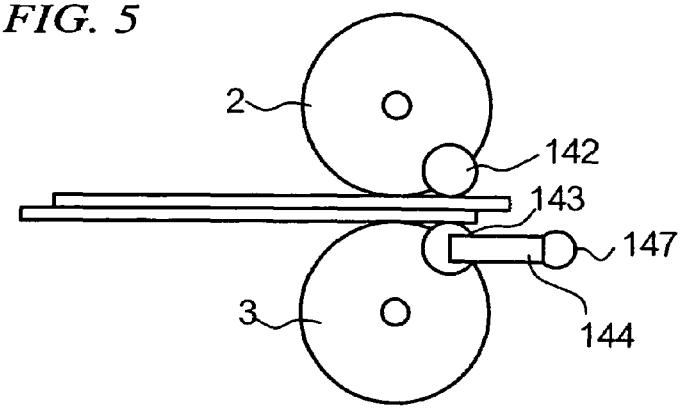
FIG. 5 is a diagram showing another example of a structure of the sheet sensor according to the exemplary embodiment.

A sheet sensor 14 is provided at the contact area A or on the downstream side of the contact area A. There are various types of sensors that can be used as sheet sensor 14, for example, an ultrasonic type (see Japanese Patent Application Open-Laid Publication No. 2000-45390), an electrostatic capacity type (see Japanese Patent Application Open-Laid Publication No. 11-301885). The type of the sheet sensor 14 is not particularly limited. For example, sheet sensors 14 as shown in FIGS. 3 to 5 may be used. In the example shown in FIG. 3, the sheet sensor 14 is constituted by a displacement meter 141 which measures displacement of the holder member 9 in the thickness direction, i.e., measures an entire thickness of all the sheets nipped at the contact area A. The controller 15 ascertains the number of sheets at the contact area A on the basis of the entire thickness of all the sheets measured by the displacement meter 141. In another example shown in FIG. 4, contact rollers 142 and 143 are provided on the downstream side of the contact area A, sandwiching a sheet conveyor path. The lower contact roller 143 is supported on a tip end of an arm 144 which can be pivoted about a fulcrum 145. An appropriate pressure is applied to the arm 144 to press the contact roller 143 against the contact roller 142. A displacement meter 146 measures displacement of the contact area A in a thickness direction of the arm 144, i.e., the entire thickness of all the sheets nipped between the contact rollers 142 and 143. Further, in another example shown in FIG. 5, an encoder 147 for measuring the rotation angle of the arm 144 is provided in place of the displacement meter 146 shown in FIG. 4. The controller 15 ascertains the number of sheets at a position on the downstream side of the contact area A, from the rotation angle measured by the encoder 147.

The controller 15 controls currents applied to the electromagnetic clutch 6 and to the motor 8, based on the number of sheets which has been detected by the sheet sensor 14 and based on the position of the sheets which has been calculated by the encoder 11 to detect rotation of the separation roller 3. A separation torque and a pressure (hereinafter referred to as contact pressure load) by which the separation roller 3 is pressed against the conveyor roller 2 are thus controlled.

In the first exemplary embodiment, the effect of separating a sheet on the side of the separation roller 3 from plural sheets which are being fed, to return the sheet to the tray is called a separation effect. The separation effect depends on control parameters such as separation torque and contact pressure load. More specifically, as the separation torque is increased, torque by which the separation roller 3 presses the sheet back in a direction of the contact area A increases. Accordingly, the separation effect of the separation roller 3 increases. In contrast, if the contact pressure load is decreased, sheets become more slippery as the separation roller 3 rotates because friction between plural sheets becomes lower than that between the separation roller 3 and a sheet, in general. Consequently, the separation effect of the separation roller 3 weakens. The controller may control either one or both of the separation torque and contact pressure load, to control the separation effect.

A conveyance method will now be described specifically.

Figure 6:
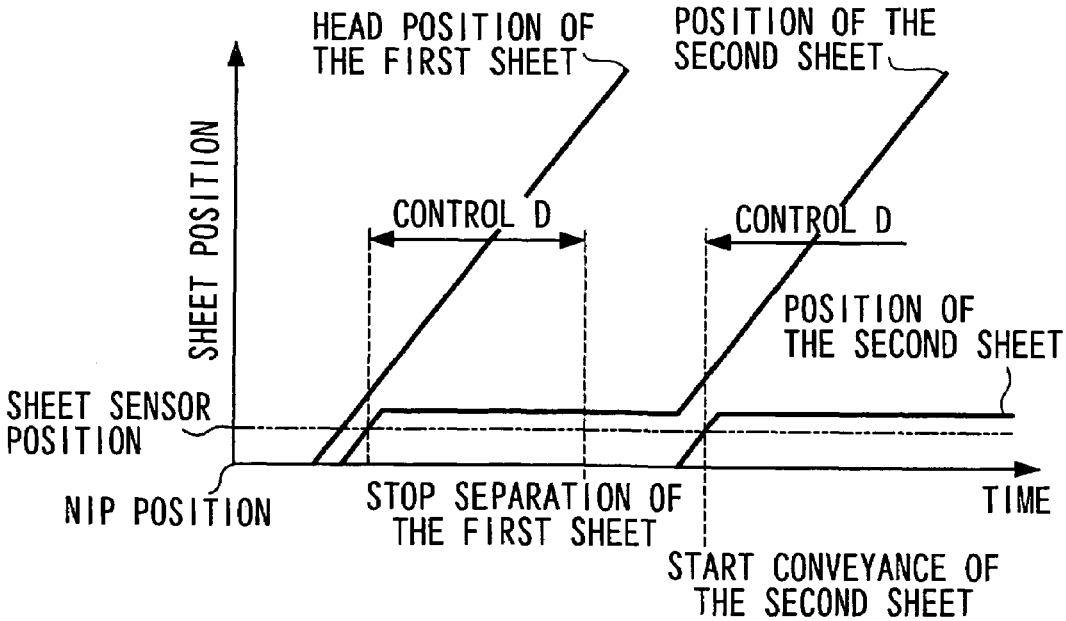
FIG. 6 is a timing chart showing actions of the lead edges of sheets when control D is performed according to the exemplary embodiment.
Figure 7A:
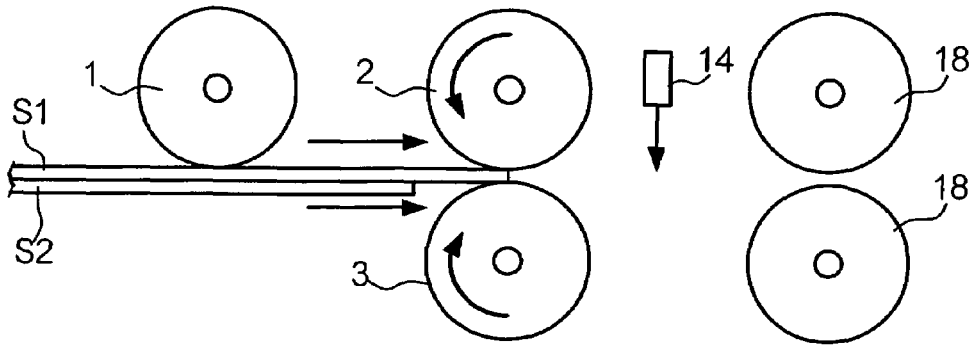
FIGS. 7A-7C are diagrams showing actions of sheets during conveyance control of sheets in a case where the sheet sensor detects two sheets, according to the exemplary embodiment.
Figure 7B:
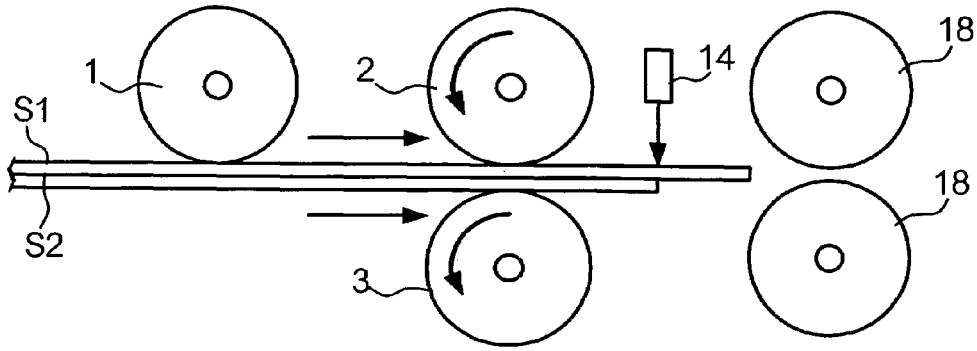

FIG. 6 shows transition of the lead edge position of each sheet in a case where two sheets are fed to the contact area A by the sheet feed roller 1. FIG. 7 show states of conveying these two sheets. To determine when to start conveying sheets, the controller 15 uses control parameters of a "mode 1" as an initial state, or in other words, control parameters by which a relatively weak separation effect is attained. Here it can be supposed that conveyance of sheets is started in the state shown in FIG. 7A.

Figure 8:
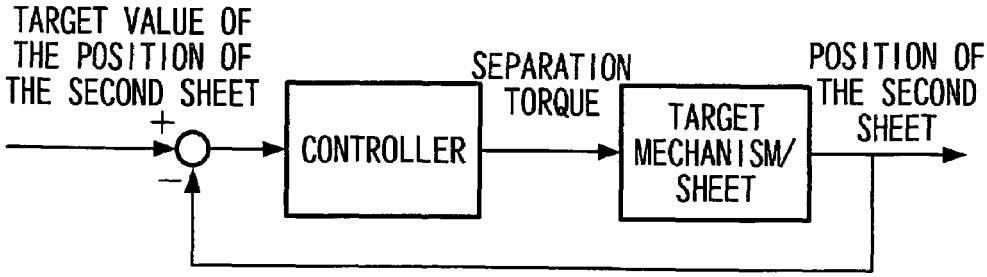
FIG. 8 is a chart showing the control D in the exemplary embodiment.

After starting conveyance, the controller 15 detects a number of sheets passing the contact area A by means of the sheet sensor 14. As shown in the example in FIG. 7B, if the number of sheets is detected to be "two" by the sheet sensor 14 while two sheets S1 and S2 are passing the contact area A, the controller 15 performs a control D to stop the lead edge of the second sheet S2 at a predetermined target position. FIG. 8 shows the contents of the control D. The outer circumference of the separation roller 3 moves substantially in the same manner as the second sheet S2. Hence in the control D, the rotation angle or the number of turns of the separation roller 3 is detected at the encoder 11, to calculate the position of the second sheet S2. Further, a difference between the sheet position of the second sheet S2 and the target position is obtained. To adjust this difference to zero, feedback control is performed by adjusting control parameters. A feedback control system for carrying out this feedback control includes, for example, a PID controller. A separation torque may be the only control parameter to be adjusted, as shown in the figure. Alternatively, a contact pressure load or both the separation torque and the contact pressure load may be control parameters to be adjusted.

Figure 7C:
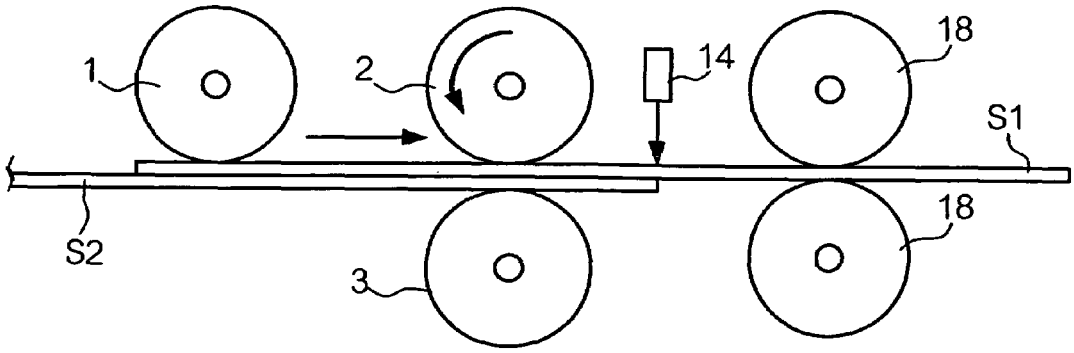

The controller 15 continues to perform the control D until the rear end of the first sheet S1 passes through the nip position. The control D works to maintain the position of the second sheet S2 at a predetermined target position until the rear end of the first sheet S1 passes through the nip position, as shown in FIG. 7C. After coming out of the nip position, the controller 15 stops rotation of the conveyor roller 2 and the separation roller 3, and waits for a predetermined time period (corresponding to a so-called inter-image time interval). When a next conveyance instruction is given, the controller 15 starts conveying the second sheet S2. At this time, the lead edge of the second sheet S2 has already come out of the contact area A into the downstream side. Therefore, the second sheet S2 is directly and smoothly conveyed in a direction toward the paired downstream conveyor rollers 18 by the conveyor roller 2 and separation roller 3. During this time a third sheet is picked up from the tray by the sheet feed roller 1 and passes the contact area A. While the second sheet S2 is being conveyed, the lead edge of the third sheet reaches the position of the sheet sensor 14. However, if the sheet sensor 14 detects "two" as the number of third sheets, the control D is performed to allow the third sheet to stay at a target position, in the same manner as described previously.

Figure 9A:
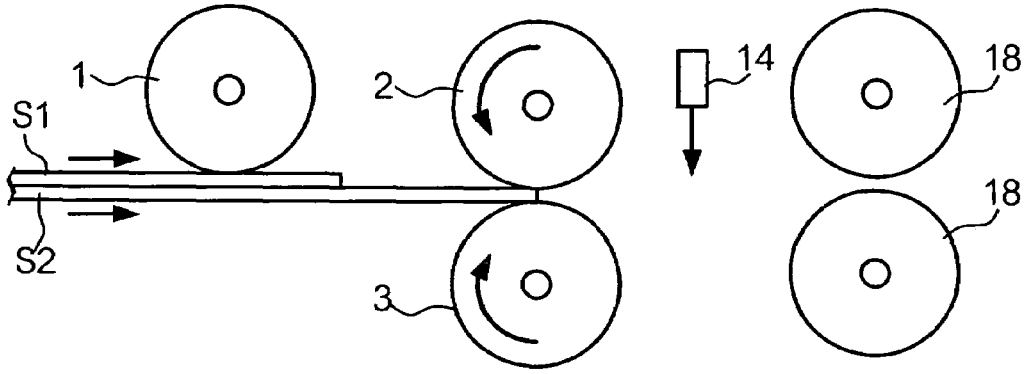
FIGS. 9A-9C are diagrams showing actions of sheets in conveyance control of sheets in a case where the sheet sensor detects two sheets, according to the exemplary embodiment.
Figure 9B:
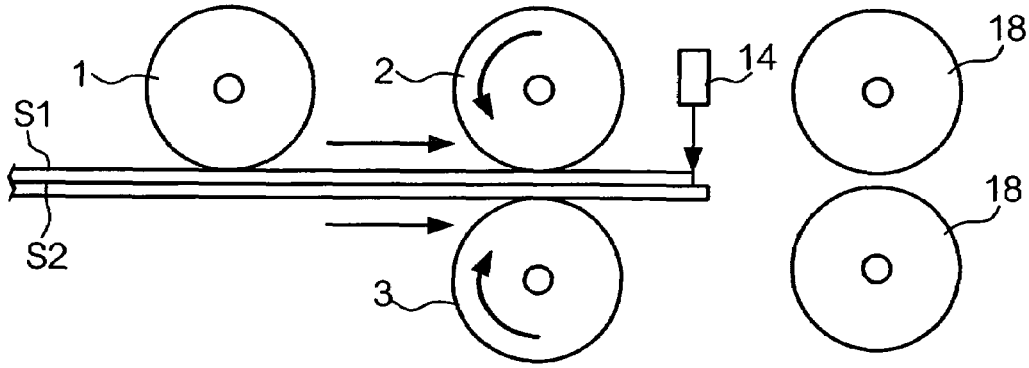
Figure 9C:
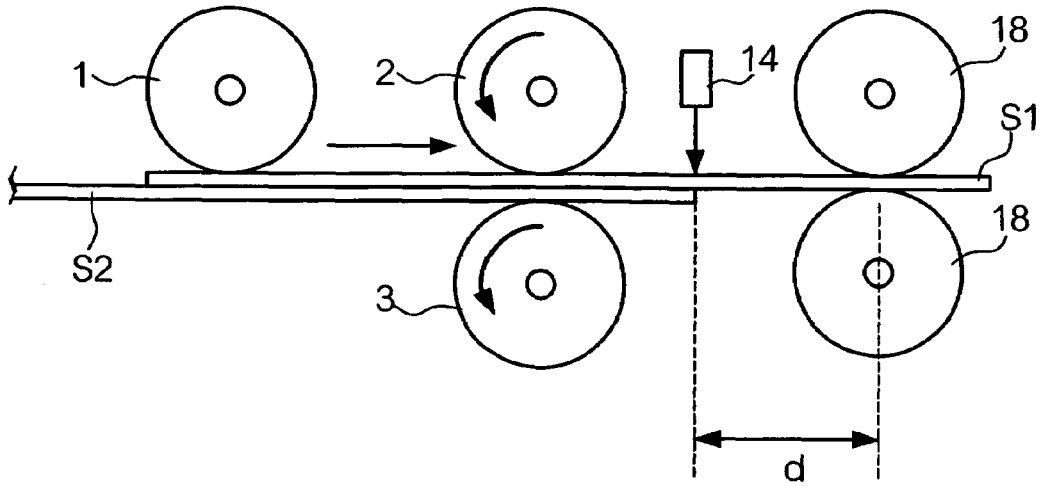

According to the method described above, double feed of sheets can be eliminated. On the other hand, a problem may arise as follows. FIG. 9 show different states within one example of conveyance of a sheet. If sheets contact each other with a high contact tension, a case may occur where a second sheet S2 situated below a first sheet S1 enters the contact area A prior to the first sheet S1, as shown in FIG. 9A. In this case, the sheet sensor 14 may detect that "two" is the number of the sheets. Immediately, the lead edge of the second sheet S2 can be moved to a predetermined target position on the downstream side of the contact area A. The control D to stop the lead edge at the target position may then be performed. Even so, the second sheet S2 along with the first sheet S1 can enter the contact area B of the paired downstream conveyor rollers 18 (i.e., double feed occurs) if there is only a short distance d between the lead edge of the second sheet S2 and the contact area B of the paired downstream conveyor rollers 18, as shown in FIG. 9C. In particular, the closer to the contact area B the position of the sheet sensor 14 is, the higher the possibility that both the first and second sheets S1 and S2 will together enter the contact area B of the paired downstream conveyance rollers 18.

In view of the foregoing, conveyance of sheets is required to be arranged as follows.

Figure 10:
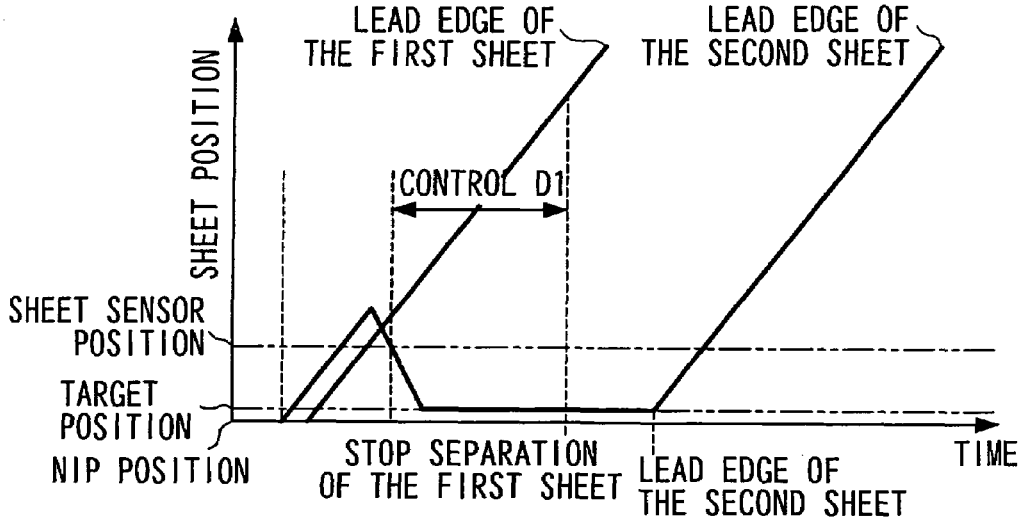
FIG. 10 is a timing chart showing motion of lead edges of sheets when control D1 is performed, according to the exemplary embodiment.
Figure 11A:
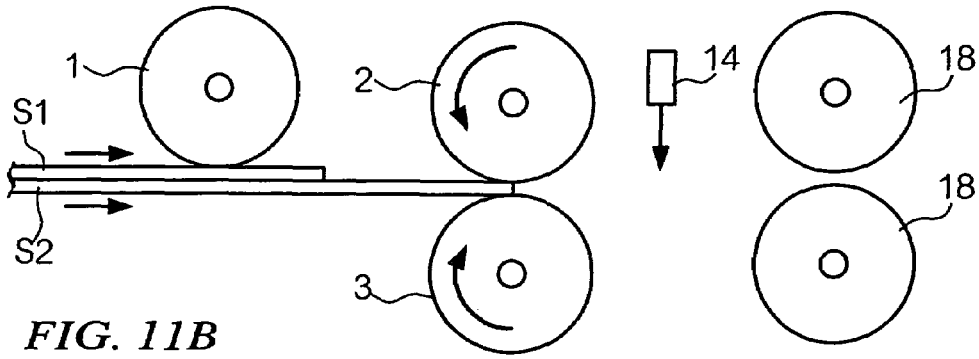
FIGS. 11A-11D are diagrams showing actions of sheets during conveyance control of sheets in a case where the sheet sensor detects two sheets, according to the exemplary embodiment.
Figure 11B:
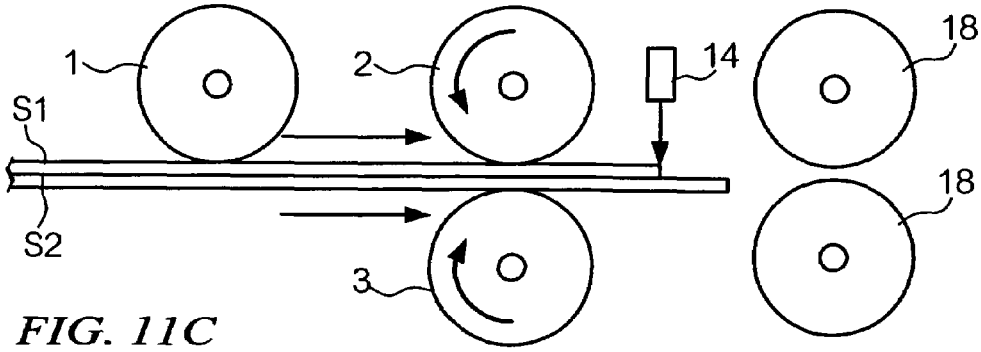

FIG. 10 shows transition of the lead edge position of each sheet in a case that two sheets are fed to the contact area A. FIG. 11 show states of conveying two sheets. As stated in the foregoing description in relation to FIG. 6, in order to determine when to start conveyance of sheets, the controller 15 uses control parameters of "mode 1" as an initial state; or in other words, uses control parameters with which a relatively weak separation effect is obtained (see FIG. 11A). Among the plural sheets, the closest sheet to the conveyor roller 2 (which is the uppermost sheet) is called a first sheet S1. The other lower sheets are respectively called a second sheet S2, third sheet S3, . . . , and N-th sheet in descending order. As shown in FIG. 11B, two sheets S1 and S2 pass the contact area A, and the number of sheets is detected to be "two" by the sheet sensor 14. Then, the controller 15 rotates the separation roller 3 in such a direction that one of the sheets is conveyed in a reverse direction opposite to the conveying direction of the conveyor roller 2. Thus, the second sheet S2 is returned to the upstream side while the first sheet S1 is conveyed to the downstream side. At this time, the controller 15 uses control parameters of "mode 2" by which a relatively strong separation effect is obtained.

The controller 15 continues the conveyance control as described above to return the second sheet S2 to the upstream side until "one" is detected as the number of sheets by the sheet sensor 14. Once the sheet sensor 14 detects the number of sheets to be "one", the controller 15 performs a control D1. The control D1 works to move the second sheet S2 to a position (target position) where the separation roller 3 has to be rotated by a predetermined rotation angle or a predetermined number of turns, and further works to maintain the second sheet S2 at this position. The phrase "a predetermined rotation angle or a predetermined number of turns" means a rotation angle or the number of turns of the separation roller 3, which is necessary to move the lead edge of the sheet returned under the control D1 to a preset target position. The target position is set between the separation roller 3 and the sheet sensor 14. This control D1 proceeds as follows, and as set out in the foregoing description relating to FIG. 8. The rotation angle or number of turns of the separation roller 3 is detected from the encoder 11. The position of the second sheet S2 is calculated from a distance obtained from the sheet sensor 14. Another difference between the sheet position of the second sheet S2 and the target position is obtained. To converge this difference to zero, a feedback control is performed to adjust control parameters. A separation torque may be the only control parameter to adjust. Alternatively, a contact pressure load or both a separation torque and a contact pressure load may be control parameters to be adjusted.

Figure 11C:
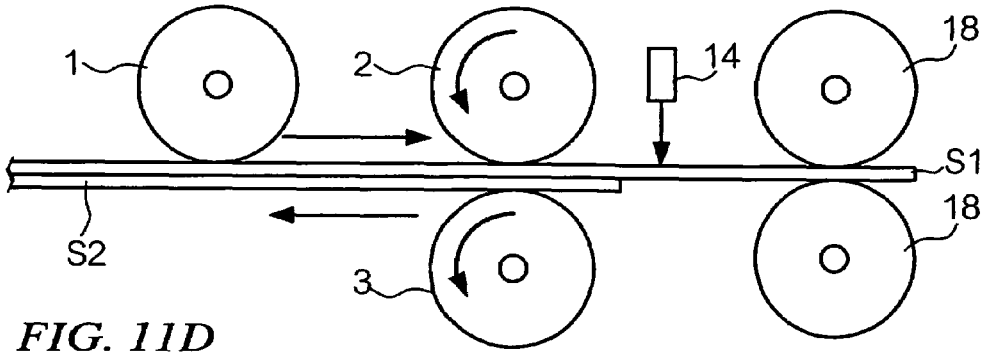
Figure 11D:
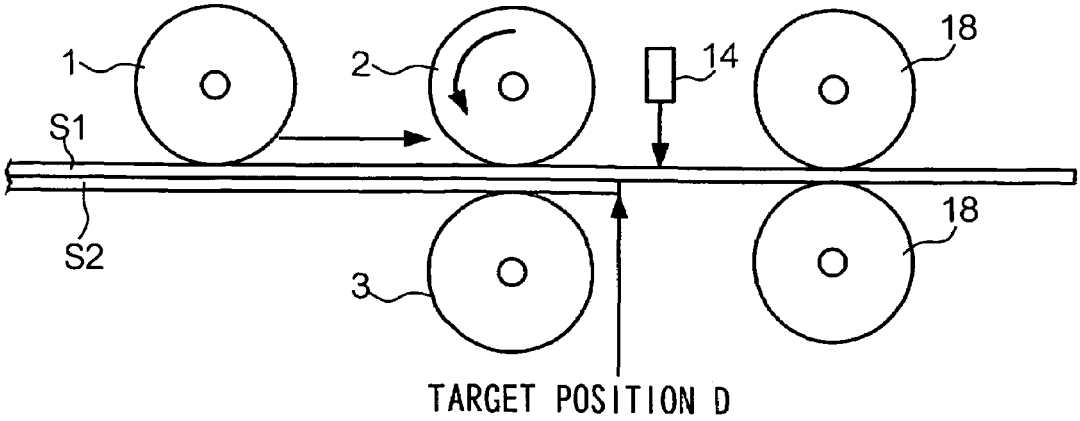

The controller 15 continues to perform the control D1 until the rear end of the first sheet passes through the nip position. This control D1 works to maintain the position of the second sheet S2 at a predetermined target position until the rear end of the first sheet S1 passes through the nip position, as shown in FIG. 11D. After the rear end of the first sheet S1 passes through the nip position, the controller 15 stops rotation of the conveyor roller 2 and the separation roller 3, and waits for a predetermined time period (corresponding to a so-called inter-image time interval). When a next conveyance instruction is given, the controller 15 starts conveying sheets. At this time, the lead edge of the previous second sheet S2 has already come out of the contact area A further into the downstream side. According to the method described above, the second sheet S2 is returned to the upstream side until the sheet sensor 14 detects "one" as the number of sheets. Further, the second sheet S2 is moved to a position (i.e., the target position) at which the separation roller 3 is rotated by a predetermined rotation angle or by a predetermined number of turns. The second sheet S2 is maintained at this position. Therefore, the distance d can be relatively long between the lead edge of the second sheet S2 and the contact area B of the paired downstream conveyor rollers 18. Accordingly, entry together of the first sheet S1 and second sheet S2 into the contact area B of the paired downstream conveyor rollers 18 (i.e., double feed) is avoided.

A case may occur where three sheets together enter the contact area A. In this case, a problem may arise as follows.

Figure 12A:
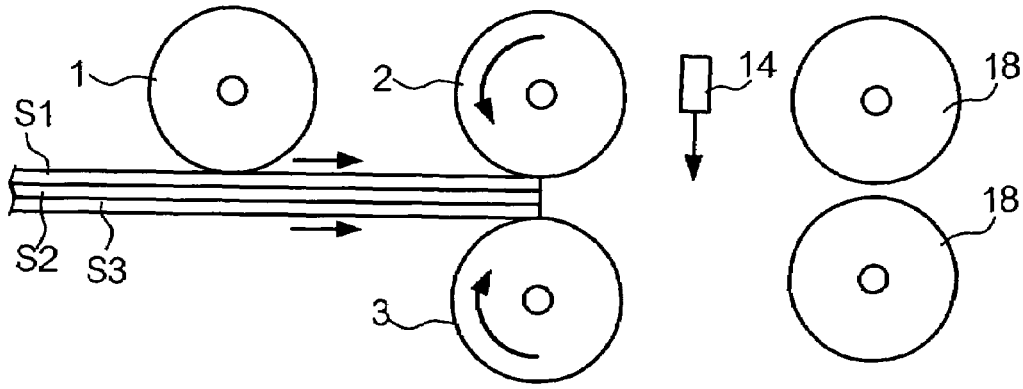
FIGS. 12A-12C are diagrams showing actions of sheets during conveyance control of sheets in a case where the sheet sensor detects three sheets, according to the exemplary embodiment.
Figure 12B:
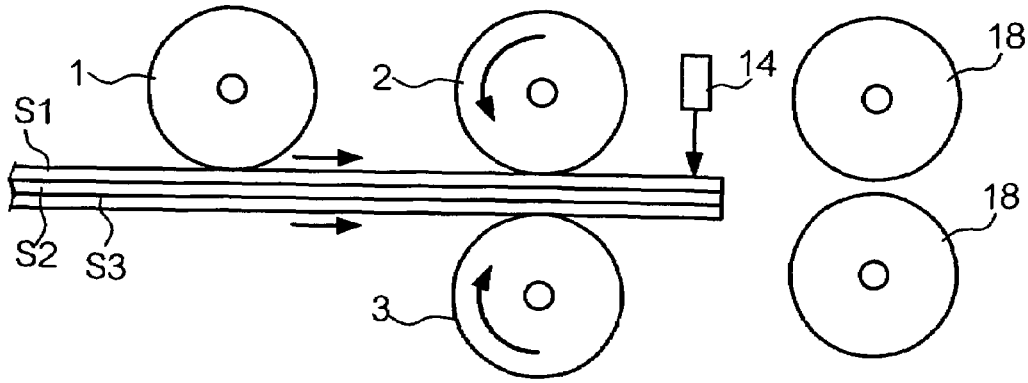

As shown in FIG. 12A, the second sheet S2 and the third sheet S3 situated below the first sheet S1 substantially simultaneously enter the contact area A. In this case, as shown in FIG. 12B, if "three" is detected as the number of sheets, the controller 15 performs the control D to return the lead edge of the third sheet S3 and stop it at a predetermined target position between the contact area A and the sheet sensor 14.

Figure 12C:
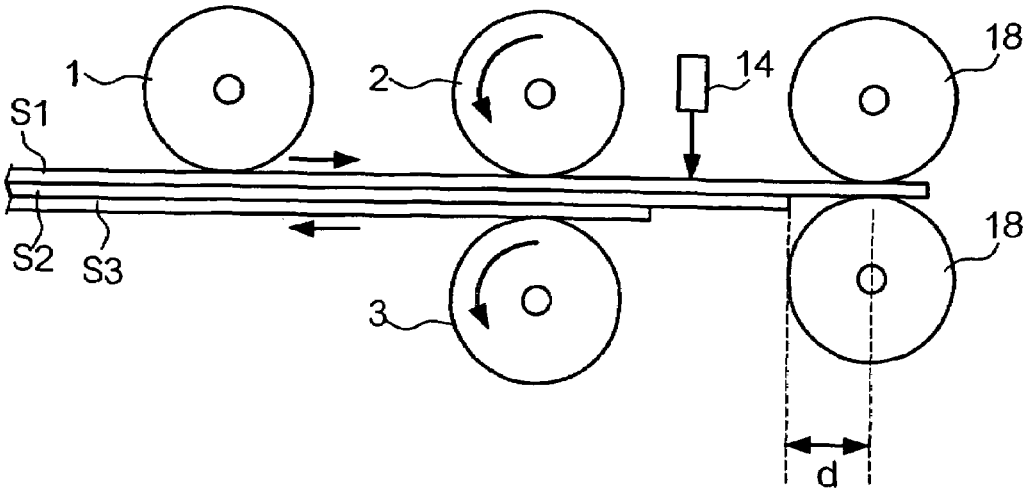

The controller 15 continues to perform the control D until the rear end of the first sheet S1 passes through the nip position. This control D works to maintain the position of the third sheet S3 at a predetermined target position until the rear end of the first sheet S1 passes through the nip position, as shown in FIG. 12C. However, if the distance d between the lead edge of the second sheet S2 and the contact area B of the paired downstream conveyor rollers 18 is relatively short, the second sheet S2 may be pulled under the effect of friction to the first sheet S1 conveyed to the downstream side and enter, together with the first sheet S1, the contact area B of the paired downstream conveyor rollers 18. In particular, it may be that while the control D is being performed to the third sheet S3 to a target position to stop it there, the second sheet S2 is gradually pulled to the downstream side due to friction acting between it and the first sheet S1. In such a case, there is a greater likelihood of the second sheet S2 entering the contact area B of the paired downstream conveyor rollers 18.

In view of the foregoing, conveyance of sheets may be controlled in a manner as follows.

Figure 13:
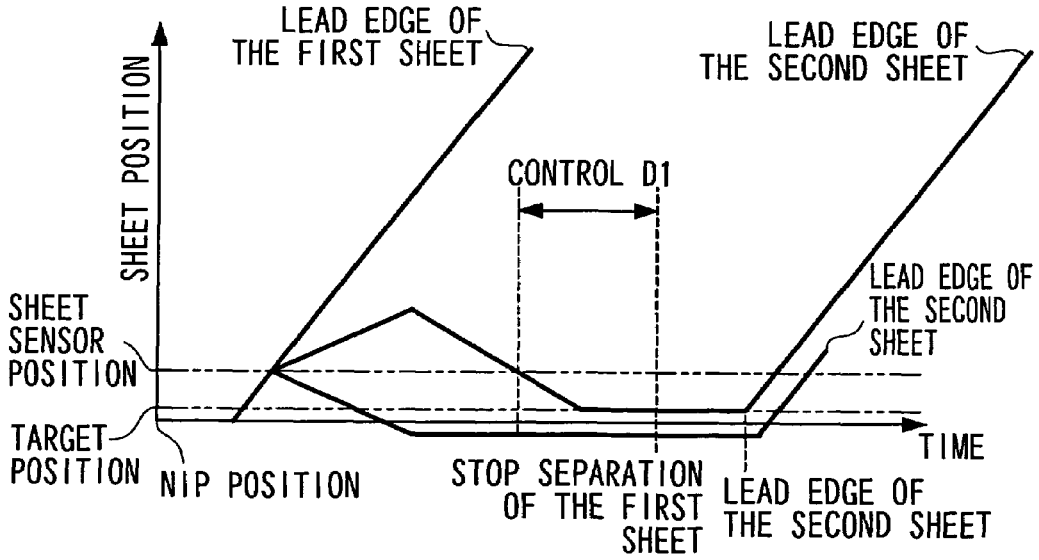
FIG. 13 is a timing chart showing motion of lead edges of sheets during conveyance control of sheets in a case where the sheet sensor detects three sheets, according to the exemplary embodiment.
Figure 14A:
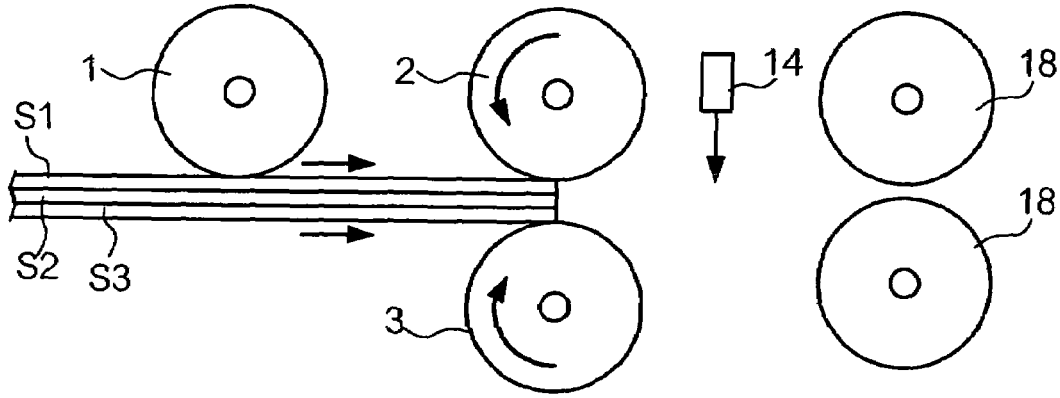
FIGS. 14A-14C are diagrams showing actions of sheets during conveyance control of sheets in a case where the sheet sensor detects three sheets, according to the exemplary embodiment.
Figure 14B:
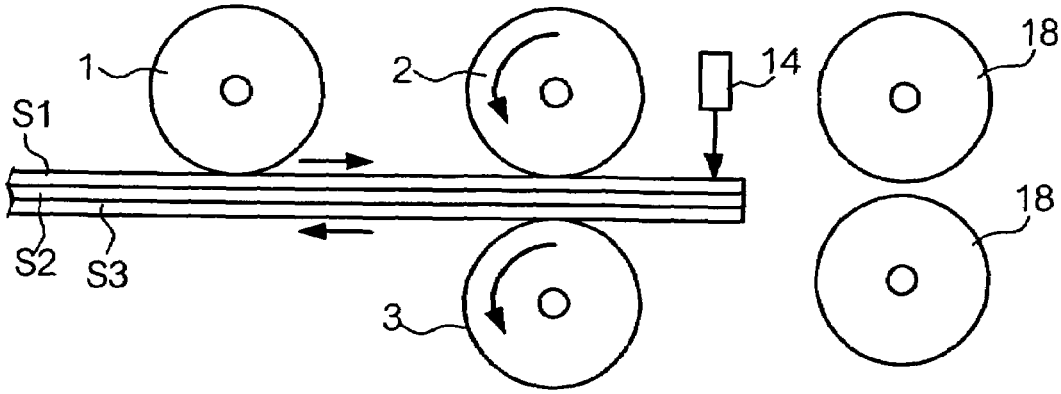
Figure 14C:
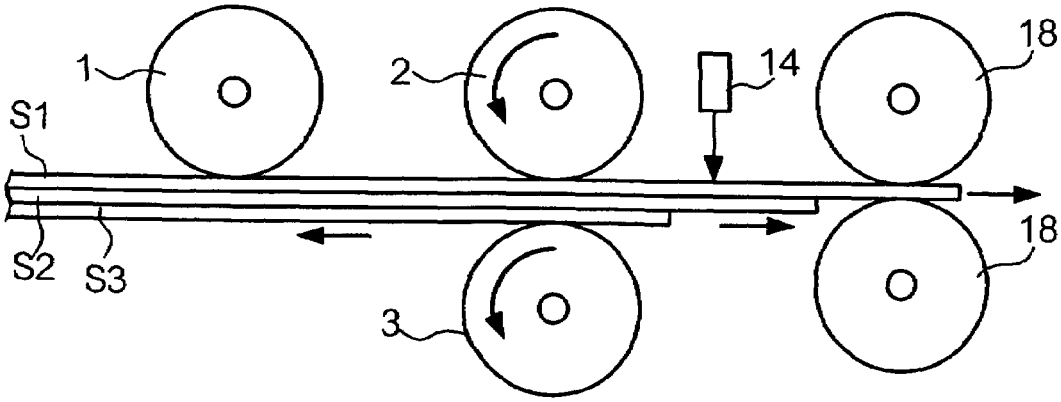

FIG. 13 shows transition of a lead edge position of each sheet in a case where three sheets are fed to the contact area A by the sheet feed roller 1. FIGS. 14 and 15 show states of these three sheets being conveyed. As described previously with reference to FIG. 6, the controller 15 starts conveyance by use of control parameters of the "mode 1" as an initial state when conveyance of sheets is carried out (see FIG. 14A). That is, control parameters are used which exert a relatively weak separation effect. If the sheet sensor 14 detects "three" as the number of sheets after starting conveyance, the controller 15 causes the separation roller 3 to rotate as shown in FIG. 14B, to return the third sheet S3 to the upstream side while conveying the first sheet S1 to the downstream side. At this time, the controller 15 uses control parameters of the "mode 2", by which a relatively strong separation effect is attained. As a result, the first sheet S1 is conveyed to the downstream side, and the third sheet S3 is returned to the upstream side, as shown in FIG. 14C. However, the second sheet S2 is gradually conveyed to the downstream side, pulled by the first sheet S1 being conveyed to the downstream side.

Figures 15A, 15B, 15C:
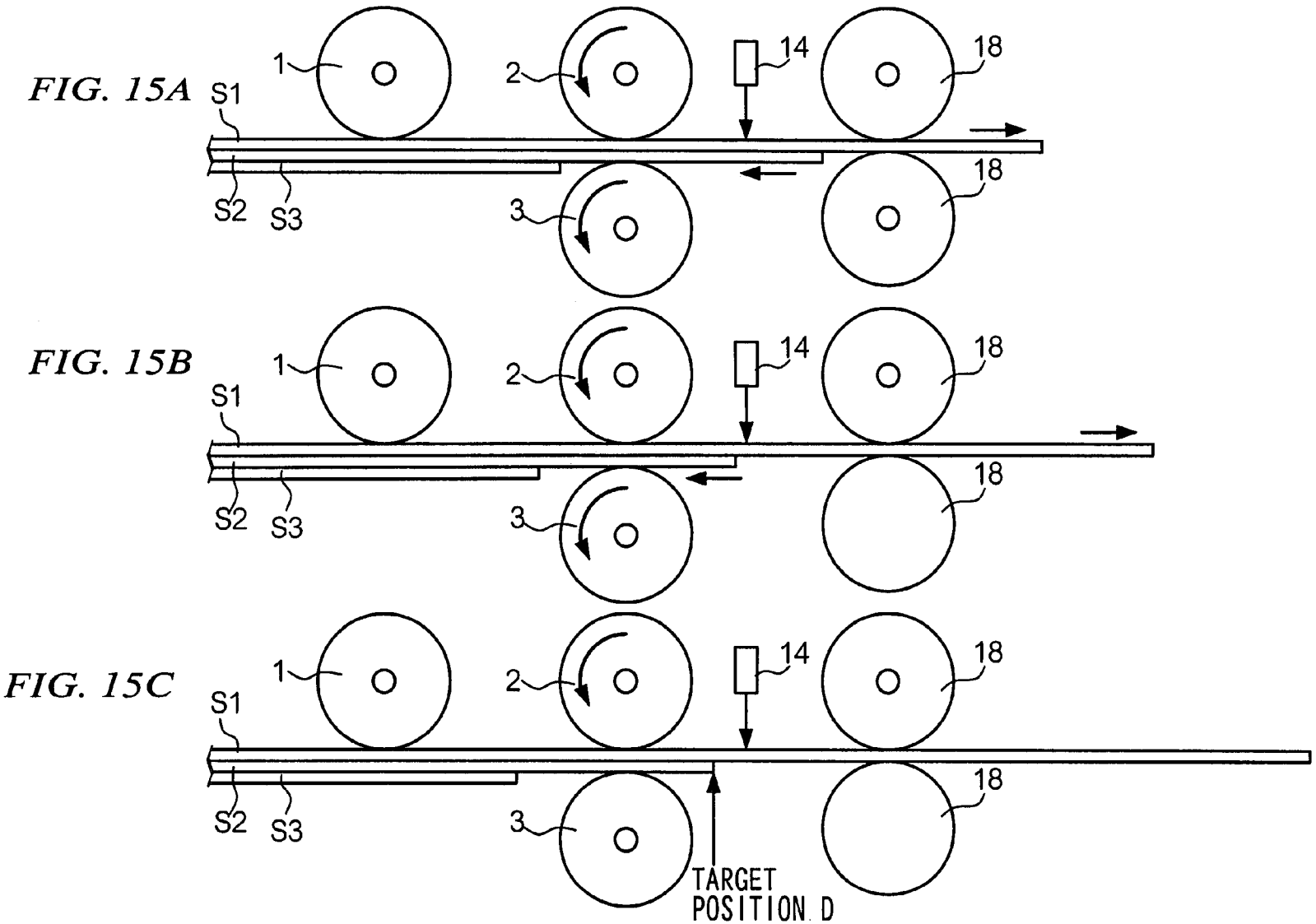
FIGS. 15A-15C are diagrams showing actions of sheets during conveyance control of sheets in a case where the sheet sensor detects three sheets, according to the exemplary embodiment.

The third sheet S3 is returned to the position of the sheet sensor 14, and the sheet sensor 14 detects "two" for the first sheet S1 and the second sheet S2 as the number of sheets. The controller 15 continues to perform control to return the third sheet S3 to the upstream side. Further, the controller 15 returns the third sheet S3 to the upstream side of the contact area A. Then, as shown in FIG. 15A, the separation roller 3 contacts the second sheet S2. As shown in FIG. 15B, the controller 15 continues conveyance control as described above, to return the second sheet S2 to the upstream side while conveying the first sheet S1 to the downstream side.

The controller 15 continues the conveyance control as described above until the sheet sensor 14 detects "one" as the number of sheets, as shown in FIG. 15B. Then, the controller 15 performs control to move the second sheet S2 to a position at which the separation roller 3 is rotated by a predetermined rotation angle or by a predetermined number of turns, and to stop the second sheet S2 at this position. The controller 15 continues to perform the control D1 until the rear end of the first sheet S1 passes through the nip position; and the control D1 works to maintain the sheet position of the second sheet S2 at a predetermined target position until the rear end of the first sheet S1 passes through the nip position, as shown in FIG. 15C. After the rear end of the first sheet S1 passes through the nip position, the controller 15 stops rotation of the conveyor roller 2 and the separation roller 3, and waits for a predetermined time period (corresponding to a so-called inter-image time interval). When a next conveyance instruction is given, the controller 15 starts to convey sheets. At this time, the preceding two sheets have already come out of the contact area A, and the second sheet thereof is conveyed further to the downstream side.

As in the above case, if N sheets (where N>3) are fed to the contact area A at the same time, the controller 15 performs the control D1 to return the third and all subsequent sheets to the upstream side of the contact area A and to allow the second sheet S2 stay at a target position. Thus, the first sheet S1 described above can be conveyed to the downstream side. That is, until the sheet sensor 14 detects "one" as the number of sheets, the N-th sheet is returned to the upstream side. Further, the second sheet S2 is moved to a position (target position) at which the separation roller 3 is rotated by a predetermined rotation angle or by a predetermined number of turns. The second sheet S2 is maintained at this position. Therefore, entry of plural sheets including the first sheet S1 into the contact area B of the paired downstream conveyor rollers 18 (i.e., double feed) can be avoided.

Figure 16:
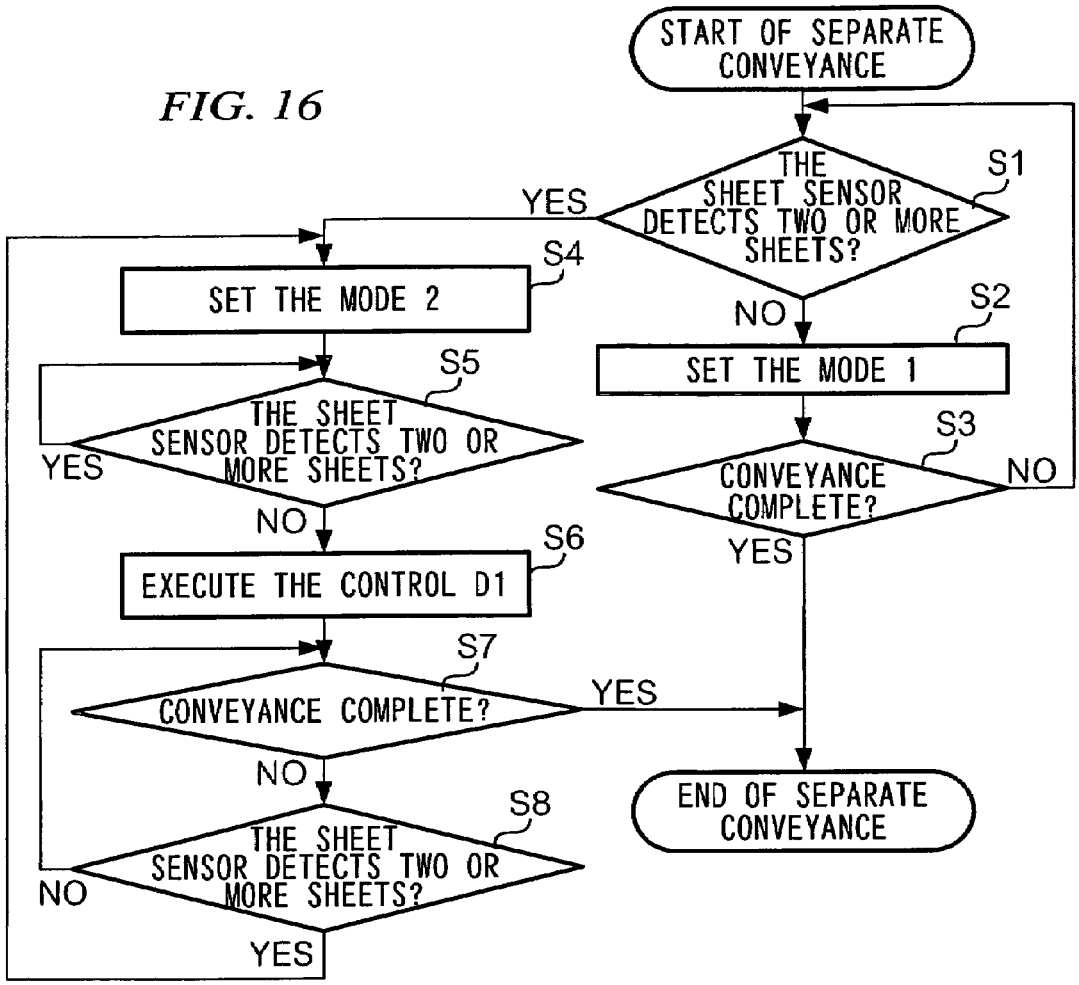
FIG. 16 is a flowchart showing operations according to the exemplary embodiment.

FIG. 16 is a flowchart for a program which the controller 15 executes to carry out separate conveyance, as described above. When a conveyance instruction is given, the controller 15 detects the number of sheets by means of the sheet sensor 14. In the period during which a sheet is being conveyed from the tray to the contact areaA (the number of detected sheets: 0) or another period during which only the first sheet S1 is passing through the contact area A (the number of detected sheets: 1) (step S1: NO), the controller 15 performs conveyance control with the mode 1 set as the operation mode (step S2). That is, the controller 15 determines whether conveyance of the first sheet S1 is complete or not while conveying sheets by use of control parameters with which a relatively weak separation effect (step S3) is obtained. While conveyance control of sheets is determined as being executed (step S3: NO), processing of steps S1 to S3 is repeated on condition that the sheet sensor 14 detects "0" or "1" as the number of sheets. The rear end of the first sheet comes out of the contact area A, and the conveyance control is then terminated (step S3: YES). Further, the processing of the step S1 described above is once again started so as to convey the second sheet.

Description will now be made of processing to be executed if the controller 15 detects "two" or more as the number of sheets, as shown in FIGS. 11B and 14B. Two or more sheets are fed to the contact area A, and the sheet sensor 14 detects "two" or more as the number of sheets (step S1: YES). Then, the controller 15 performs conveyance control with the mode 2 set as the operation mode (step S4). That is, the controller 15 performs conveyance of sheets by use of control parameters by which a relatively strong separation effect is attained. As long as the sheet sensor 14 continues detecting "two" or more as the number of sheets (step S5: YES), the controller 15 executes processing in the mode 2 to return sheets other than the first sheet S1 to the upstream side while conveying the first sheet S1, as shown in FIGS. 11C and 14C. Thereafter, if "one" is detected as the number of sheets by the sheet sensor 14 (step S5: NO), the controller 15 performs the control D1 to cause the second sheet S2 to stay at a target position, as shown in FIGS. 11D and 15C (step S6). Further, the controller 15 determines whether conveyance of the first sheet S1 is complete or not, while performing the control D1 (step S7). While conveyance control of sheets is determined as being executed (step S7: NO), the control D1 is continued to be performed on condition that the sheet sensor 14 detects "0" or "1" as the number of sheets (Step S8: NO). When the rear end of the first sheet comes out of the contact area A, the conveyance control ends (step S7: YES). Then, the processing of the step S1 described above is restarted to convey the second sheet.

Even while the controller 15 performs the control D1, any of the second and subsequent sheets may be conveyed to the downstream side if any of the second and subsequent sheets is pulled to the downstream side due to friction generated by contact with the first sheet S1. In this case, the sheet sensor 14 detects "two" or more as the number of sheets (step S8: YES). Then, the device 15 performs the steps S4 to S7 with respect to sheets other than the first sheet S1 while conveying the first sheet S1 to the downstream side with the mode 2 set as the operation mode, as described above. These steps work as a process for returning sheets other than the first sheet S1 to the upstream side. When the rear end of the first sheet comes out of the contact area A, conveyance control ends (step S7: YES). Then, the processing of the step S1 described above is restarted to convey the second sheet.

The first exemplary embodiment described above may be modified as follows.

Figure 17:
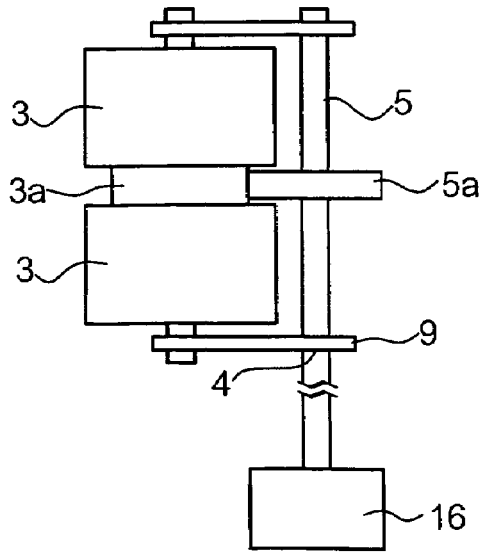
FIG. 17 is a diagram showing a structure of a separation roller and a drive system thereof, according to a modification of the exemplary embodiment.

For example, the first exemplary embodiment employs the electromagnetic clutch 6 for variable control of a separation torque. In place of this clutch, a DC motor 16 may be used as shown in FIG. 17. If the separation roller 3 is provided with a separation torque to return a sheet to the side of the contact area A, the direction and size of a drive current flowing through the DC motor 16 are each adjusted such that a rotation torque corresponding to the separation torque is generated in the same direction as the motor 7, as shown in FIG. 2. This modification makes it possible to switch both an amount and a direction of a torque to be applied to the separation roller 3, by adjusting the current flowing through the DC motor 16. Therefore, it is not necessary to use the electromagnetic clutch 6 shown in FIG. 2.

Second Exemplary Embodiment

As has been described in the above first exemplary embodiment, after a sheet reaches the contact area A, the conveyor roller 2 carries out conveyance of the sheet. During that time the sheet feed roller 1 is separated from the rotation drive system thereof, and is in a free state. The sheet feed roller 1 rotates as the sheet is conveyed. In this state, if a separation torque generated by the separation roller 3 and rotation in an opposite direction to the conveying direction of the separation roller act on the sheet, the conveying speed of the sheet is reduced.

Figure 19:
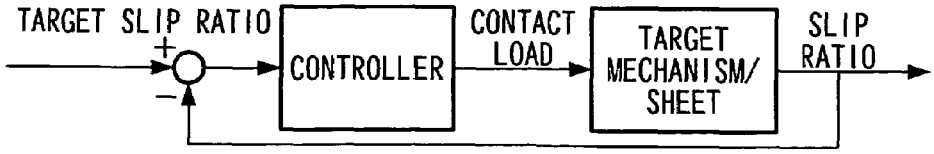
FIG. 19 is a chart showing control S according to the second exemplary embodiment.
Figure 18:
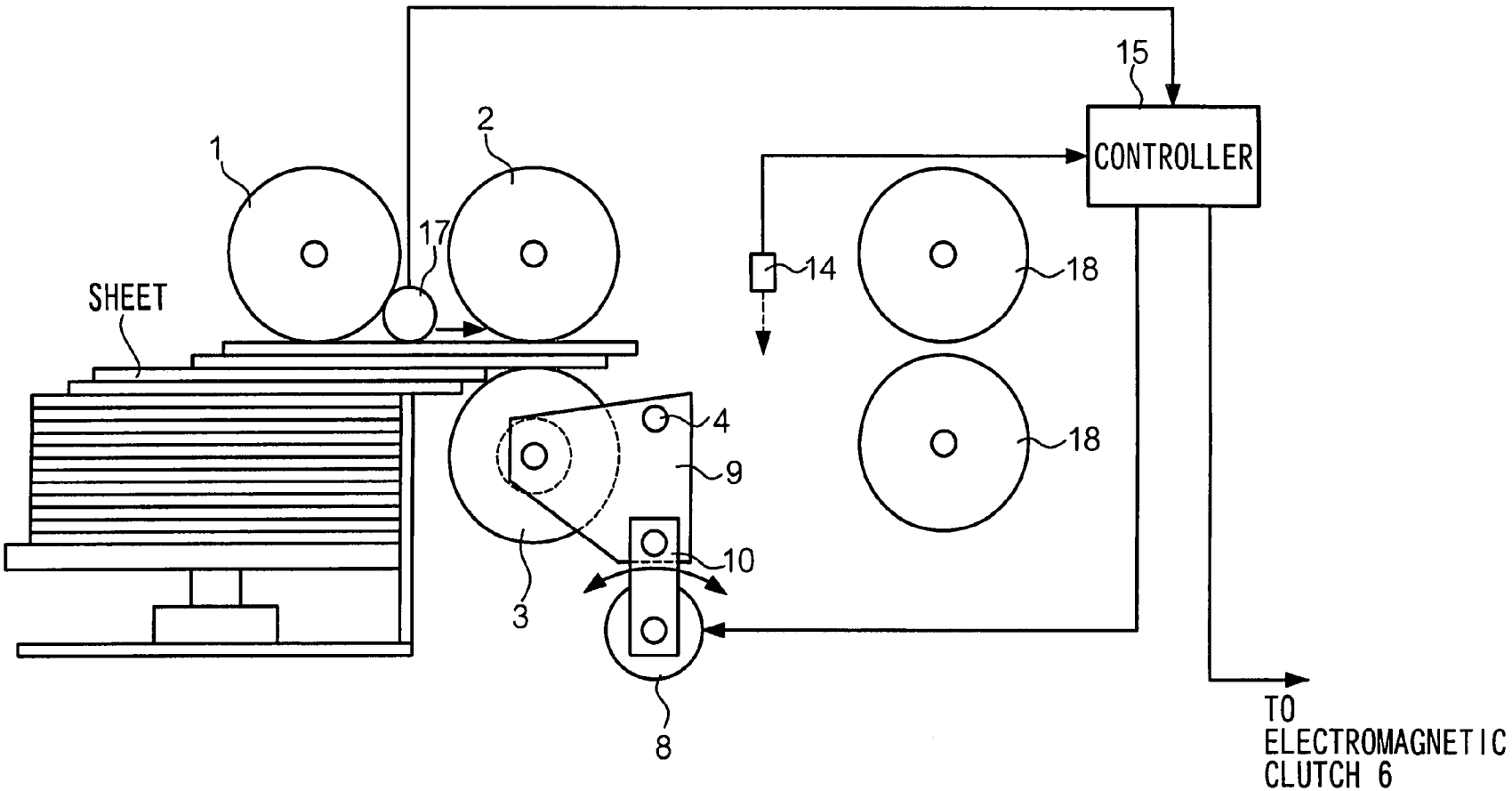
FIG. 18 is a diagram showing a structure of a sheet feed device according to a modification of the present invention.

In the second exemplary embodiment described below, a reduction in the conveying speed of this sheet is restrained so as to further stabilize conveyance of sheets. FIG. 18 is a view showing the structure of a sheet feed device according to the second exemplary embodiment. This sheet feed device is provided with a sheet speed sensor 17 to detect speeds of sheets conveyed. The controller 15 has a function of performing control S as shown in FIG. 19, in addition to the function of performing the control D1 of the first exemplary embodiment. In the control S, feedback control is carried out to obtain a difference between a sheet speed detected by the sheet speed sensor 17 and a predetermined target speed, and to adjust a contact pressure load so that the sheet speed increases to that of the target speed or more. As in the first exemplary embodiment, the control system for the feedback control includes a PID controller.

Figure 20:
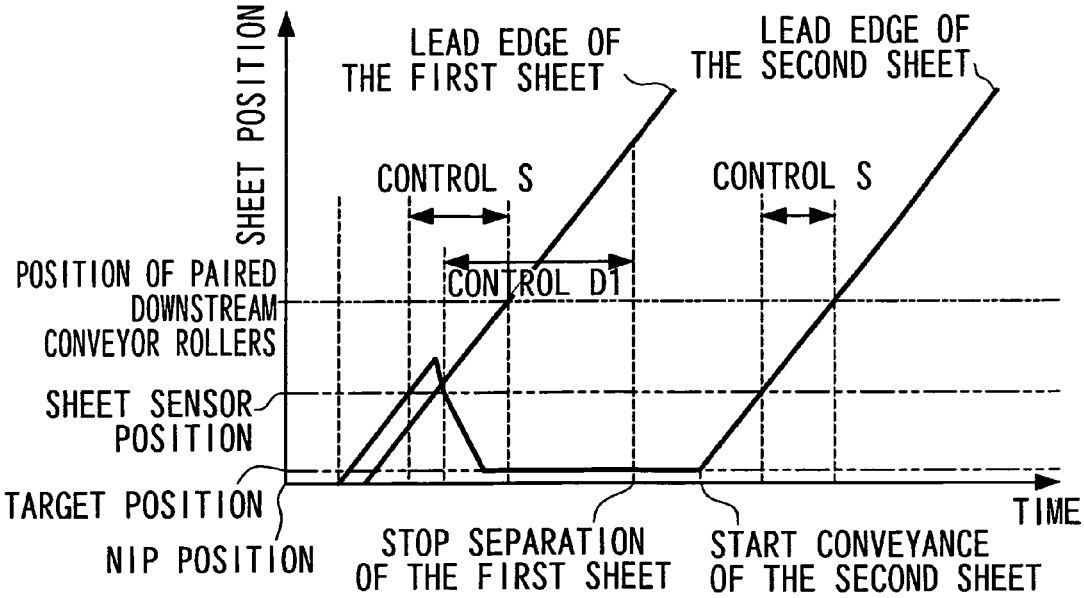
FIG. 20 is a timing chart showing motion of lead edges of sheets according to the exemplary embodiment.

FIG. 20 shows periods during which the control S and the control D1 are performed. The figure adopts an example in which two sheets are fed to the contact area A. The period during which the control D1 is performed is the same as that in the foregoing exemplary embodiment. The control S is performed during a period starting from when the lead edge of a sheet reaches the contact area A and the sheet sensor 14 detects the number of sheets, to when the lead edge of the sheet reaches the paired downstream conveyor rollers 18 and conveyance thereof is taken over by the paired rollers. The control S is carried out in parallel with the control D.

Figure 21:
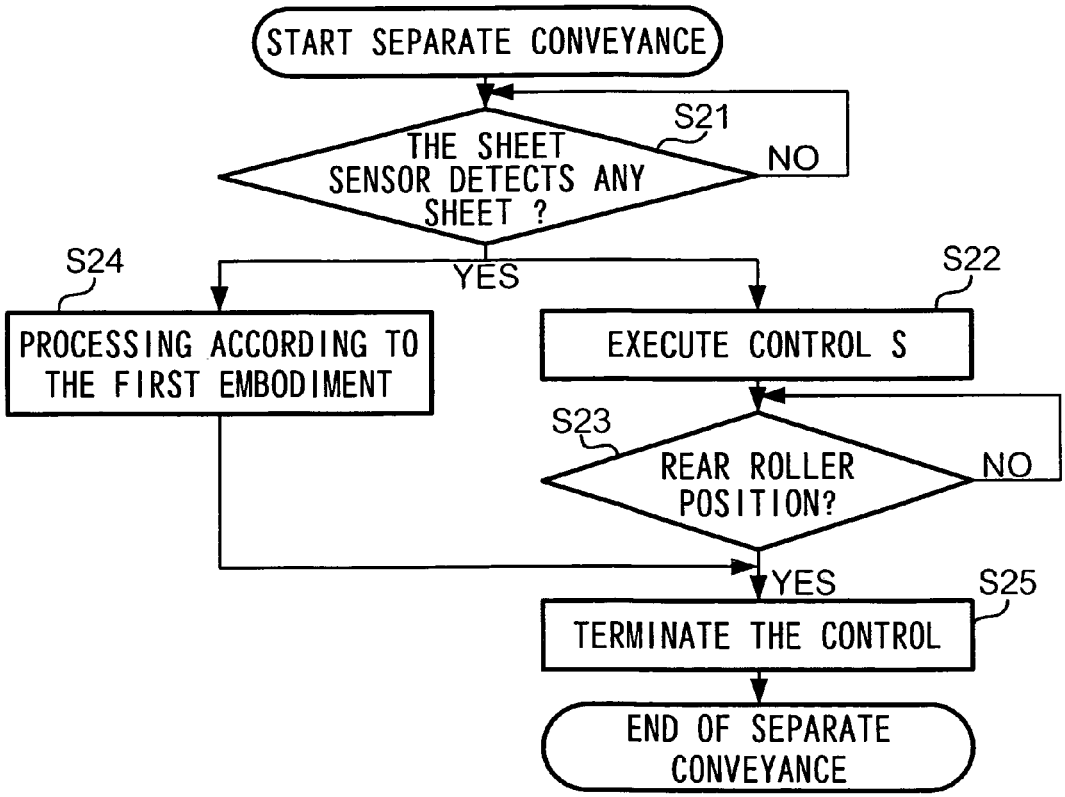
FIG. 21 is a flowchart showing actions according to the exemplary embodiment.

FIG. 21 is a flowchart showing processing to perform control as described above. As shown in this figure, if a number of sheets is detected by the sheet sensor 14 after a conveyance instruction is given (step S21: YES), the controller 15 performs the control S until the lead edge of any sheet is detected as having reached the contact area B of the paired downstream conveyor rollers 18 (steps S22 and S23). In this case, the number of sheets detected is not relevant. On the other hand, the controller 15 executes the processing shown previously in FIG. 16. In this processing, the modes 1 and 2 are switched, depending on whether the sheet sensor 14 detects "two" or more as the number of sheets. Of the control parameters at this time, only the separation torque is switched over and the contact pressure load is not switched over. This is because the contact pressure load is a target to be controlled under control S in the step S22 executed in parallel with the step S24. After both of the steps S23 and S24 are concluded, the controller 15 terminates the conveyance control (step S25), and terminates the processing.

In another aspect of the invention, an image forming apparatus that includes a sheet feed mechanism described above.

Figure 22:
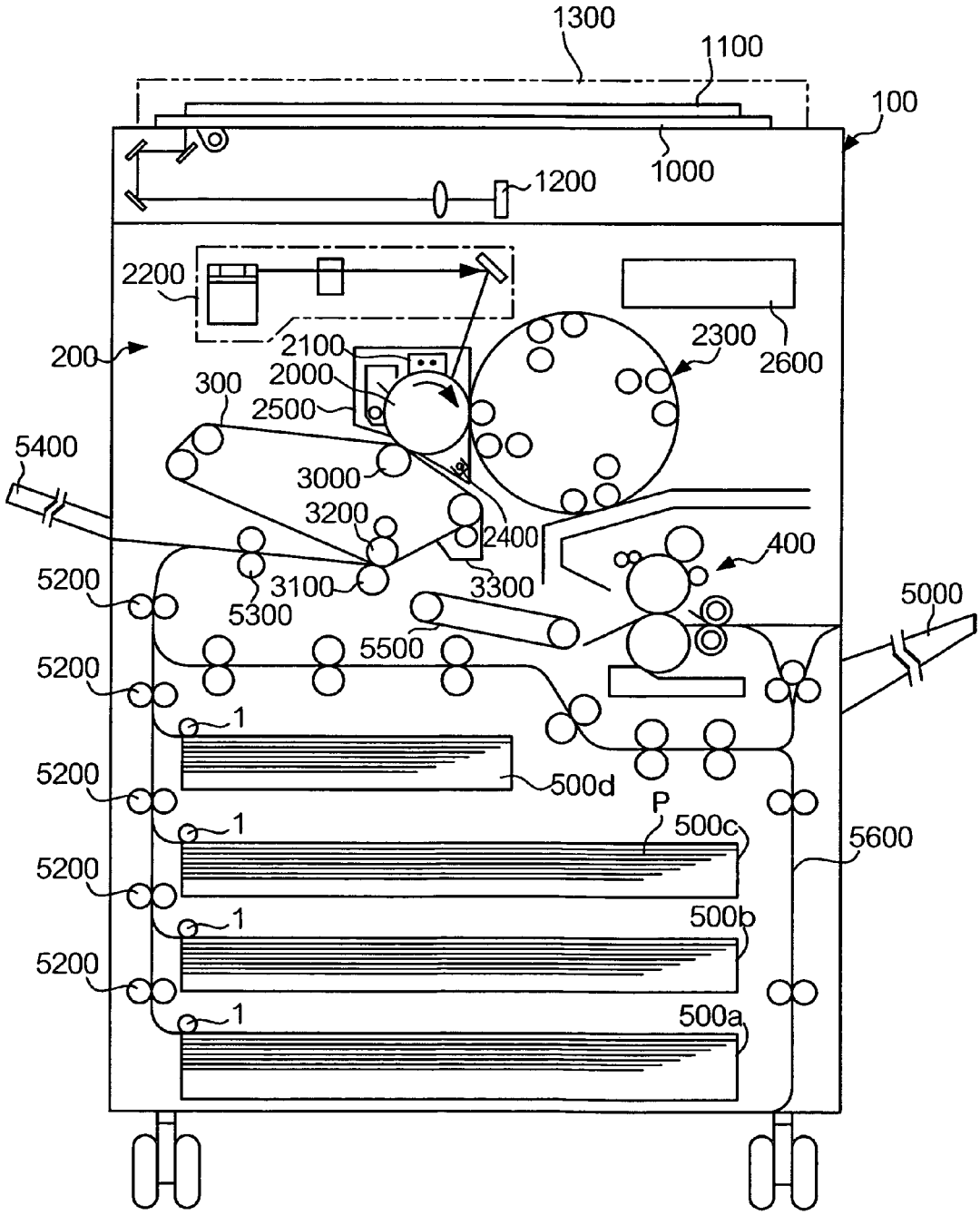
FIG. 22 shows a configuration of an image forming apparatus with a built-in sheet feeding apparatus according to the exemplary embodiment.

FIG. 22 is a cross-section view showing a constitution of a digital color copier, which is an image forming apparatus with a built-in sheet feeding apparatus according to the exemplary embodiment of the present invention. This copier is provided with an image input portion 100 for optically reading an image on a document 1100 placed on a platen glass 1000 and converting it to electric image data using a CCD sensor 1200, and an image forming portion 200 for forming an image on a recording sheet P based on the image data transferred from the image input portion 100.

The image forming portion 200 forms an image on the recording sheet P by forming a toner image on a photosensitive drum 2000 based on the image data transferred from the image input portion 100, and then performing first image transfer of the toner image to an endless intermediate image transfer belt 300, and further performing second image transfer of the toner image on the intermediate image transfer belt 300 to the recording sheet P. The recording sheet P onto which the toner image underwent second image transfer is ejected onto an ejection sheet tray 5000 after passing through a fixing device 400. Specifically, the photosensitive drum 2000 rotates in the direction of the arrow at a prescribed process speed, and around it are disposed a charge corotron 2100 for uniformly charging a surface of the photosensitive drum 2000 up to a prescribed background potential, a laser beam scanner 2200 for forming an electrostatic latent image on the photosensitive drum 2000 by exposing the photosensitive drum 2000 using a laser beam modulated based on the image data, a rotary developer unit 2300 having black, yellow, magenta, and cyan color developing devices for developing the electrostatic latent image on the photosensitive drum using one of the developing devices, an image transfer preprocessing corotron 2400 for removing the potential from the photosensitive drum 20 ahead of first image transfer of the toner image to the intermediate image transfer belt 300, and a cleaner 2500 for removing residual toner on the photosensitive drum 2000 after first image transfer of the toner image is complete.

The intermediate image transfer belt 300 is stretched across multiple rollers and rotates in the direction of the arrow, the color toner images formed sequentially on the photosensitive drum 2000 are transferred onto the intermediate image transfer belt 3 in an overlaid fashion, and then undergo second image transfer in a batch to the recording sheet P from the intermediate image transfer belt 300. A first image transfer roller 3000 for forming an image transfer electric field between the intermediate image transfer belt 300 and the photosensitive drum 2000 is disposed in a position opposing the photosensitive drum 2000 sandwiching the intermediate image transfer belt 300, while a second image transfer roller 3100 and an opposing electrode roller 3200 are disposed sandwiching the intermediate image transfer belt 300 at a position of second image transfer of the toner image, and the recording sheet P receives image transfer of the toner image when passing between the second image transfer roller 3100 and the intermediate image transfer belt 300. Along the rotating path of the intermediate image transfer belt 300, a belt cleaner 3300 for eliminating paper dust and residual toner from the surface of the intermediate image transfer belt 300 which has finished second image transfer is provided the second image transfer position and the first image transfer position.

Sheet trays 500*a* to 500*d* in four levels which store the recording sheets P of different sizes are provided below the image forming portion 200. A recording sheet P of an appropriate size corresponding to the document size detected by the image input portion 1 is sent to the image forming portion 200 from one of the sheet trays by a sheet feed roller 1. Multiple sheet transporting rollers 5200 are disposed along the transporting path of the recording sheet P from the sheet trays 500*a* to 500*d* until reaching the second image transfer position of the toner image. A sheet registration roller 5300 is disposed upstream in the transporting direction of the second image transfer position. The sheet registration roller 5300 sends the recording sheet P sent from the sheet trays 500*a* to 500*d* to the second image transfer position at a prescribed timing synchronized with the timing of writing the electrostatic latent image on the photosensitive drum 2000.

Note that in FIG. 1, reference numeral 1300 is a platen glass, reference numeral 2600 is an image processing portion for supplying image data transferred from the image input portion 100 to the image forming portion 200 to the laser beam scanner 2200 after processing it according to the type of copying being done, reference numeral 5400 is a manual sheet tray used during manual sheet feeding of recording sheets P, reference numeral 5500 is a sheet transporting belt for transporting the recording sheet P onto which the toner image has undergone second image transfer to the fixing device 400, and reference numeral 5600 is an inverter path for inverting the recording sheet P and transporting it to the second image transfer position from the fixing device 400 when performing double-sided copying of the recording sheet P.

Figure 23:
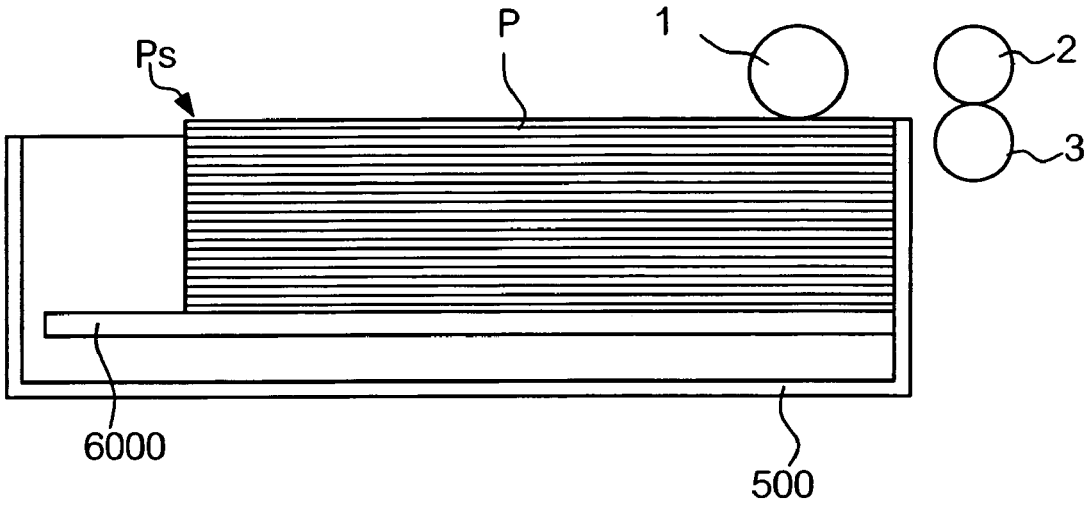
FIG. 23 shows a configuration of sheet trays 500*a* to 500*d*.

FIG. 23 is a view showing a detailed constitution of the sheet tray 500 (sheet trays 500*a* to 500*d*).

The sheet tray 500 is formed in an approximately rectangular shape provided with a storage area for the recording sheets P, and is constituted such that the recording sheets P can be inserted from a front side (the side in front of the paper in FIG. 1) into the copier casing constituting a sheet feeding portion. The recording sheets P are loaded into the sheet tray 500 and a bottom plate 6000 is provided for raising the recording sheets P upwards. The sheet feed roller 1 is provided corresponding to the front edge of the recording sheet P positioned in the sheet tray 500 on the copier casing side into which the sheet tray 500 is inserted, and when the recording sheet P is raised by the rising of the bottom plate 6000, the front edge of the recording sheet P positioned topmost in the sheet tray 500 presses against sheet feed roller 1. Due to this, when the sheet feed roller 51 rotates, a prescribed friction force acts between the recording sheet P and the sheet feed roller 1, and the topmost recording sheet P is pulled out of the sheet tray 500. A conveyer roller 2 and a separation roller 3 are provided adjacent to the sheet feed roller 1 on the copier casing side.

The foregoing description of the exemplary embodiments of the present invention is provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feed device comprising:

a conveyor roller that rotates in a first conveying direction to convey a sheet for conveyance;

a separation roller that is pressed against the conveyor roller, to nip the sheet for conveyance at a contact area formed between the separation roller and the conveyor roller, the separation roller being rotatable in a second direction, reverse to the first, conveying direction, to convey a sheet for separation;

a sheet detector that is provided at a detecting position at the contact area or downstream of the contact area, to detect a number of sheets for conveyance passing through the detecting position;

a pressure generator that generates a pressure by which the separation roller is pressed against the conveyor roller;

a separation torque generator that generates a separation torque by which the sheet for separation on the separation roller is conveyed in the second, reverse direction; and a controller that, if two or more sheets are detected at the sheet detector, applies at least one of the pressure and the separation torque to the separation roller to separate the sheets one by one, until the number of sheets detected at the sheet detector is decreased to be one, and that if one sheet is detected at the sheet detector or after the sheet detector detects the number of sheets to be now one, controls at least one of the pressure and the separation torque, to adjust and maintain a position of a lead edge the sheet for separation on the separation roller to a target position between the contact area and the detecting position, until conveyance of the sheet for conveyance on the conveyor roller finishes.

2. A sheet feed device comprising:

a conveyor roller that rotates in a first conveying direction to convey a sheet for conveyance;

a separation roller that is pressed against the conveyor roller, to nip the sheet for conveyance at a contact area formed between the separation roller and the conveyor roller, the separation roller being rotatable in a second direction, reverse to the first, conveying direction, to convey a sheet for separation;

a sheet detector that is provided at a detecting position at the contact area or downstream of the contact area, to detect a number of sheets for conveyance passing through the detecting position;

a pressure generator that generates a pressure by which the separation roller is pressed against the conveyor roller;

a separation torque generator that generates a separation torque by which the sheet for separation on the separation roller is conveyed in the second, reverse direction; and a sheet speed sensor that detects a conveying speed of the sheet being conveyed by the conveyor roller;

a controller that controls the pressure such that the conveying speed of the sheet detected by the sheet speed sensor is not lower than a predetermined value, and that, if two or more sheets are detected at the sheet detector, applies at least one of the pressure and the separation torque to the separation roller to separate the sheets one by one, until the number of sheets detected at the sheet detector is decreased to be one, and that if one sheet is detected at the sheet detector or after the sheet detector detects the number of sheets to be now one, controls at least one of the pressure and the separation torque, to adjust and maintain a position of a lead edge the sheet for separation on the separation roller to a target position between the contact area and the detecting position, until conveyance of the sheet for conveyance on the conveyor roller finishes.

3. The sheet feed device according to claim 1, further comprising:

an encoder that detects a rotation angle or the number of turns of the separation roller, wherein after the sheet detector detects one as the number of sheets, the separation roller is rotated by a predetermined rotation angle or a predetermined number of turns, based on the rotation angle or the number of turns detected by the encoder, to convey the sheet nipped between the conveyor roller and the separation roller to the target position.

4. The sheet feed device according to claim 2, further comprising:

an encoder that detects a rotation angle or the number of turns of the separation roller, wherein after the sheet detector detects one as the number of sheets, the separation roller is rotated by a predetermined rotation angle or a predetermined number of turns, based on the rotation angle or the number of turns detected by the encoder, to convey the sheet nipped between the conveyor roller and the separation roller to the target position.

5. The sheet feed device according to claim 1, wherein the controller has a storage that stores first and second control parameters by which the separation roller is rotated to separate from one another a plurality of sheets nipped between the conveyor roller and the separation roller, the second control parameter allowing a stronger separation effect to be obtained than a separation effect obtained with the first control parameter, and if the sheet detector detects one as the number of sheets, the controller controls at least one of the pressure and the separation torque by use of the first parameter, or if the sheet detection section detects two or more sheets, the controller controls at least one of the pressure and the separation torque by use of the second parameter.

6. The sheet feed device according to claim 2, wherein the controller has a storage that stores first and second control parameters by which the separation roller is rotated to separate from one another a plurality of sheets nipped between the conveyor roller and the separation roller, the second control parameter allowing a stronger separation effect to be obtained than a separation effect obtained with the first control parameter, and if the sheet detector detects one as the number of sheets, the controller controls at least one of the pressure and the separation torque by use of the first parameter, or if the sheet detection section detects two or more sheets, the controller controls at least one of the pressure and the separation torque by use of the second parameter.

7. An image forming apparatus comprising:

an image forming unit that forms an image on a sheet;

a conveyor roller that rotates in a first conveying direction to convey a sheet to be supplied to the image forming unit;

a separation roller that is pressed against the conveyor roller, to nip the sheet for conveyance at a contact area formed between the separation roller and the conveyor roller, the separation roller being rotatable in a second direction, reverse to the first, conveying direction, to convey a sheet for separation;

a sheet detector that is provided at a detecting position at the contact area or downstream of the contact area, to detect a number of sheets for conveyance passing through the detecting position;

a pressure generator that generates a pressure by which the separation roller is pressed against the conveyor roller;

a separation torque generator that generates a separation torque by which the sheet for separation on the separation roller is conveyed in the second, reverse direction; and a controller that, if two or more sheets are detected at the sheet detector, applies at least one of the pressure and the separation torque to the separation roller to separate the sheets one by one, until the number of sheets detected at the sheet detector is decreased to be one, and that if one sheet is detected at the sheet detector or after the sheet detector detects the number of sheets to be now one, controls at least one of the pressure and the separation torque, to adjust and maintain a position of a lead edge the sheet for separation on the separation roller to a target position between the contact area and the detecting position, until conveyance of the sheet for conveyance on the conveyor roller finishes.

8. An image forming apparatus comprising:

an image forming unit that forms an image on a sheet;

a conveyor roller that rotates in a first conveying direction to convey a sheet to be supplied to the image forming unit;

a separation roller that is pressed against the conveyor roller, to nip the sheet for conveyance at a contact area formed between the separation roller and the conveyor roller, the separation roller being rotatable in a second direction, reverse to the first, conveying direction, to convey a sheet for separation;

a sheet detector that is provided at a detecting position at the contact area or downstream of the contact area, to detect a number of sheets for conveyance passing through the detecting position;

a pressure generator that generates a pressure by which the separation roller is pressed against the conveyor roller;

a separation torque generator that generates a separation torque by which the sheet for separation on the separation roller is conveyed in the second, reverse direction; and a sheet speed sensor that detects a conveying speed of the sheet being conveyed by the conveyor roller;

a controller that controls the pressure such that the conveying speed of the sheet detected by the sheet speed sensor is not lower than a predetermined value, and that, if two or more sheets are detected at the sheet detector, applies at least one of the pressure and the separation torque to the separation roller to separate the sheets one by one, until the number of sheets detected at the sheet detector is decreased to be one, and that if one sheet is detected at the sheet detector or after the sheet detector detects the number of sheets to be now one, controls at least one of the pressure and the separation torque, to adjust and maintain a position of a lead edge the sheet for separation on the separation roller to a target position between the contact area and the detecting position, until conveyance of the sheet for conveyance on the conveyor roller finishes.

9. The image forming apparatus according to claim 7, further comprising:

an encoder that detects a rotation angle or the number of turns of the separation roller, wherein after the sheet detector detects one as the number of sheets, the separation roller is rotated by a predetermined rotation angle or a predetermined number of turns, based on the rotation angle or the number of turns detected by the encoder, to convey the sheet nipped between the conveyor roller and the separation roller to the target position.

10. The image forming apparatus according to claim 8, further comprising:

an encoder that detects a rotation angle or the number of turns of the separation roller, wherein after the sheet detector detects one as the number of sheets, the separation roller is rotated by a predetermined rotation angle or a predetermined number of turns, based on the rotation angle or the number of turns detected by the encoder, to convey the sheet nipped between the conveyor roller and the separation roller to the target position.

11. The image forming apparatus according to claim 7, wherein the controller has a storage that stores first and second control parameters by which the separation roller is rotated to separate from one another a plurality of sheets nipped between the conveyor roller and the separation roller, the second control parameter allowing a stronger separation effect to be obtained than a separation effect obtained with the first control parameter, and if the sheet detector detects one as the number of sheets, the controller controls at least one of the pressure and the separation torque by use of the first parameter, or if the sheet detection section detects two or more sheets, the controller controls at least one of the pressure and the separation torque by use of the second parameter.

12. The image forming apparatus according to claim 8, wherein the controller has a storage that stores first and second control parameters by which the separation roller is rotated to separate from one another a plurality of sheets nipped between the conveyor roller and the separation roller, the second control parameter allowing a stronger separation effect to be obtained than a separation effect obtained with the first control parameter, and if the sheet detector detects one as the number of sheets, the controller controls at least one of the pressure and the separation torque by use of the first parameter, or if the sheet detection section detects two or more sheets, the controller controls at least one of the pressure and the separation torque by use of the second parameter.

* * * * *